US005163496A

United States Patent [19]

Jacob

[11] Patent Number: 5,163,496

[45] Date of Patent: Nov. 17, 1992

[54] PROCESS FOR TREATING OLD FOUNDRY SAND FOR REUSE IN PLACE OF CORE SAND

[75] Inventor: Hermann Jacob, Seevetal, Fed. Rep. of Germany

[73] Assignee: Georg Fischer AG, Schaffhausen, Switzerland

[21] Appl. No.: 754,961

[22] Filed: Sep. 4, 1991

[30] Foreign Application Priority Data

Sep. 5, 1990 [CH] Switzerland ..... 02897/90

[51] Int. Cl.[5] ..... B22C 1/00

[52] U.S. Cl. ..... 164/5; 134/6; 134/7; 134/37

[58] Field of Search ..... 164/5; 134/6, 7, 37

[56] References Cited

FOREIGN PATENT DOCUMENTS 60-216949 10/1985 Japan ..... 164/5

*Primary Examiner*—Kuang Y. Lin

*Attorney, Agent, or Firm*—Bachman & LaPointe

[57] ABSTRACT

The present invention relates to a process for treating old foundry sand for reuse in place of core sand wherein the precleaned sand grains are subjected to further abrasive-thermal treatment so as to volatize and remove basic constituents adhering to the precleaned sand grains.

5 Claims, No Drawings

PROCESS FOR TREATING OLD FOUNDRY SAND FOR REUSE IN PLACE OF CORE SAND

BACKGROUND OF THE INVENTION

The present invention relates to a process for treating old foundry sand for reuse in place of core sand wherein the precleaned sand grains are subjected to further abrasive-thermal treatment so as to volatize and remove basic constituents adhering to the precleaned sand grains.

Various processes are known for treating old foundry sands. These processes comprise separating the spent additives and their carbonized residuals, etc. from the quartz sand so as to enable one to reuse at least the quartz sand obtained from the processes. These known processes have been catagorized as mechanical reconditioning processes and thermal reconditioning processes. In the mechanical reconditioning processes, certain cleaning of the sand grains is achieved by means of the effect of impact and abrasion. In thermal processes, the binder shells and coatings present on the grains are burnt off.

The success of the aforementioned processes in separating quartz sand and spent binders vary widely as as basic constituents still adhere to and surround the individual sand grains. In addition, the thermal reconditioning processes suffer from the disadvantage that additional waste disposal measures due to the thermal process impose a burden on the environment.

Naturally, it would be highly desirable to provide a process for the reconditioning treatment of old foundry sand wherein the reclaimed sand material can be used as core sand wherein the individual sand grains are freed from the binder fractions and basic constituents so that they no longer have a negative influence on the curing process during the production of the core.

Accordingly, it is the principle object of the present invention to provide a process for treating old foundry sand for recycle in the place of core sand for the production of foundry cores.

It is a further object of the present invention to provide a process as aforesaid wherein the old foundry sand is precleaned in a first stage in a known manner and thereafter further treated so as to volatize and remove the basic constituents adhering to the precleaned sand grains.

Further objects and advantages of the present invention will appear hereinbelow.

SUMMARY OF THE INVENTION

In accordance with the present invention the foregoing objects and advantages are readily obtained.

The present invention relates to a process for treating old foundry sand for reuse in place of core sand wherein the precleaned sand grains are subjected to further abrasive-thermal treatment so as to volatize and remove basic constituents adhering to the precleaned sand grains. The process comprises treating old foundry sand in a first stage so as to separate and remove the outer, dead-burnt oolitizing sheaths from individual sand grains so as to form a precleaned sand. The precleaned sand is thereafter contacted with an abrasive material in a stream of heated air in a second stage so as to volatize the basic constituents adhering to the precleaned sand grains wherein the abraded basic constituents are removed as fine dust. In accordance with the preferred embodiment of the present invention the abrasive material comprises pulsating steel wool bundles and the precleaned sand grains are heated by the stream of heated air to a temperature of about 50° C. to about 70° C. During the treatment of the precleaned sand grains in the second stage, the basic constituents removed as fine dust are continuously sucked-off by pneumatic means.

The process of the present invention produces a reclaimed sand material which can be readily used as a core sand in the production of foundry cores.

DETAILED DESCRIPTION

In the foundry art, molds formed of molding sand are generally used in the production of castings. Because of the various additives used in the production of the foundry molds, the sand is partially destroyed as a result of the thermal effect of the liquid metal poured into the mold. Cores, which are used to form the cavities in a casting, are destroyed during the shaking out of the casting and the cores are mixed with the bentonite-bound sand during the shaking out of the castings. The mixture of the bentonite-bound old sand and core sand cannot be reused due to the acidically reacting core binders.

It has been found that considerable amount of basic constituents, such as, amines, sodium carbonate or sodium hydroxide adhere to the sand grains of old foundry sand even after typical pneumatic-mechanical reconditioning treatment. It is possible to determine the pH of the sand mixture and determine therefrom the condition of the sand mixture and its potential for reuse.

The process of the present invention provides a further treatment for removing the basic constituents adhering to individual sand grains thereby allowing the sand to be recycled in place of core sand. In accordance with the process of the present invention, the old foundry sand coming from the foundry as first treated in a known mechanical-pneumatic manner in a first stage so as to separate and remove the outer, dead-burnt oolitizing sheaths surrounding the individual sand grains. The outer sheath is removed by the effect of abrasion, striking an impact between the individual sand grains in the first stage treatment. In accordance with the present invention, the precleaned sand grains are thereafter contacted with an abrasive material in a stream of heated air in a second stage so as to volatize the basic constituents adhering to the precleaned sand grains wherein the abraded basic constituents are removed as fine dust. Thus, in the second stage of the process of the present invention, the precleaned sand mixture is loosened by means of pulsating bundles of abrasive material, such as, for example, steel wool, to such an extent that the individual grains are exposed to abrasive contact with the steel wool. At the same time, heated air is drawn through the bundles of steel wool so as to initiate the volatization of the basic constituents. The volatization temperature of the basic constituents is relatively low and between about 50° C. to about 70° C. The vaporizing fraction of basic substances is simultaneously sucked-off and the abraded basic constituents removed as fine dust in the second stage of the process.

The process of the present invention allows for old foundry sand to be treated to a degree wherein the sand is suitable for recycle as core sand.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

I claim:

1. A process for treating old foundry sand for recycle in place of core sand comprising:

a) treating said old foundry sand in a first stage so as to separate and remove the outer, dead-burnt oolitizing sheaths from individual sand grains so as to form precleaned sand grains; and b) contacting said precleaned sand grains in a second stage in a stream of heated air with an abrasive material so as to volatize basic constituents adhering to said precleaned sand grains wherein the abraded basic constituents are removed as fine dust.

2. A process according to claim 1 wherein the precleaned sand grains are heated by said stream of heated air to a temperature of about 50° C. to about 70° C.

3. A process according to claim 2 wherein said abrasive material are steel wool bundles.

4. A process according to claim 2 wherein the fine dust is continuously sucked-off.

5. A process according to claim 2 wherein said old foundry sand is mechanically-pneumatically treated in the first stage.

* * * * *